United States Patent [19]

Scarpa

[11] Patent Number: 4,835,054

[45] Date of Patent: May 30, 1989

[54] INTUMESCENT PROTECTIVE COVERING FOR ELECTRICAL CABLES

[75] Inventor: Jack G. Scarpa, Madison, Ala.

[73] Assignee: USBI Booster Production Company, Inc., Huntsville, Ala.

[21] Appl. No.: 64,357

[22] Filed: Jun. 22, 1987

[51] Int. Cl.[4] ..... D02G 2/00

[52] U.S. Cl. ..... 428/377; 174/136; 428/256; 428/262; 428/380; 428/913; 428/921

[58] Field of Search ..... 428/256, 262, 913, 921, 428/377, 380; 174/136

[56] References Cited

U.S. PATENT DOCUMENTS

| | | | |
|---|---|---|---|
| 2,279,791 | 4/1942 | Lamb | 169/2 |
| 4,292,358 | 12/1981 | Fryer et al. | 428/135 |
| 4,493,945 | 1/1985 | Feldman | 174/68 |

*Primary Examiner*—Marion C. McCamish
*Attorney, Agent, or Firm*—Kevin E. McVeigh

[57] ABSTRACT

A protective covering for electrical cables having a thermally intumescent coating supported on an open network of metal fibres is disclosed. A method of using the covering to prevent the spread of shipboard fires comprising applying the covering to shipboard electrical cables is also disclosed.

1 Claim, 1 Drawing Sheet

INTUMESCENT PROTECTIVE COVERING FOR ELECTRICAL CABLES

DESCRIPTION

1. Technical Field

The field of art to which this invention pertains is fire prevention and more specifically articles for containing and preventing the spread of fire.

2. Background Art

The electrical system of a ship poses a particular problem with respect to the containment of shipboard fires. Electrical cables typically traverse bulkheads and decks to form a network that connects otherwise isolated areas of the ship. Such a network provides an avenue for the spread of fire from one compartment of the ship to another through the flow of burning thermoplastic electrical insulation.

The tortuous and convoluted pathways typically followed by shipboard electrical cables are not readily amenable to the use of protective conduits as might be a case, for example, in the electrical system of a building. Further, there is a need to retrofit fire protection systems to existing electrical cables.

Previous approaches to the problem have included the use of various thermal insulations, such as asbestos, glass fiber or ceramic coverings to protect the electrical cables from fire. However, current carrying conductors dissipate heat and the added thermal insulation inhibits transfer of the heat generated by the cable to the surroundings. As a result, the operating temperature of an electrical cable with added thermal insulation is increased relative to a cable with no thermal insulation carrying the same current. In many cases, the thermally insulated cable must be "derated" to a lower current capacity to avoid operating temperatures that might degrade the electrical insulation on the cable. In the design stage, this difficulty may be overcome by specifying a wire of larger diameter. Increasing the wire diameter to compensate for derating is clearly not a viable approach in the case of retrofitting thermal insulation to existing wiring. Therefore, if thermal insulation is applied to existing shipboard wiring, the wiring must typically be derated to a lower current capacity than that for which it was designed.

What is needed in this art is a method for preventing the spread of shipboard fires that overcome the above shortcomings.

DISCLOSURE OF INVENTION

A protective covering for electrical cables is disclosed. The covering comprises a network of corrosion resistant metal fibers coated with a nonflammable, thermally intumescent material to form a flexible mesh having unobstructed open spaces defined by the coated fibers. The open spaces allow heat transfer from the cable during operation at normal ambient temperature. Upon exposure to temperatures greater than about 300° F. the intumescent material expands to obstruct the open spaces of the mesh and forms a means for containing melting thermoplastic insulation for the cable and preventing the spread of fire.

Another aspect of the invention is a method for preventing the spread of fire onboard a ship which comprises applying the above covering over a shipboard electrical cable.

The foregoing and other features and advantages of the present invention will become more apparent from the following description and accompanying drawings.

BEST MODE FOR CARRYING OUT THE INVENTION

A thermally intumescent coating material is a material that partially volatilizes at a fixed temperature to form a porous matrix.

Any nonflammable, moisture resistant, thermally intumescent coating material with an activation temperature below that of the melting point of the thermoplastic insulation on the electrical cable to be protected may be used with the present invention. An organic solvent based intumescent coating material is preferred over aqueous based systems because of the superior moisture resistance of the solvent based coatings. An organic solvent based intumescent coating material known as ALBI 107A, available from ALBI Manufacturing, Division of Stanchem, Inc., is preferred. ALBI 107A reacts to form a carbonaceous foam at temperatures of about 300° F. or greater. ALBI 107A comprises organic solvents, a synthetic resin binder, inorganic fillers and intumescing components.

While the substrate fiber network of the present invention may comprise any corrosion resistant metallic fiber, a woven stainless steel screen is the preferred substrate. The fiber diameter and density of the weave are chosen to impart flexibility to the substrate and to provide a substrate having a void area of between about 60% and about 80%. The diameter of the fibers of the substrate is preferably between 0.005 inch and 0.015 inch and most preferably between about 0.008 inch and 0.012 inch. The density of the mesh is chosen to give the desired void volume. For example, fiber with a diameter of 0.009 inch gives a void volume of about 70% when woven into a mesh of 18×18 fibers per square inch.

Figure 1:
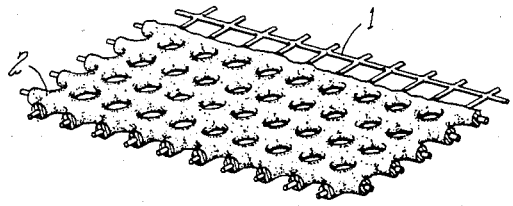
FIG. 1 shows a section of the covering of the present invention.

It is preferred that the coating be spray applied to the substrate. Conventional paint spray equipment is suitable for this purpose. The coating may be spray applied to one or to both sides of the substrate. It may be necessary to adjust the viscosity of the coating with a suitable solvent to both ease the application process and insure that the coating does not occlude the open spaces of the mesh prior to thermal activation of the coating. It is, however, preferred that the void area of the coated mesh be such that the coating will substantially occlude the open spaces of the mesh upon thermal activation of the coating. This balance typically corresponds to a preferred void area of between 30% and 40% of the projected area of the covering. The relative weight percent of coating necessary to achieve the desired void area will differ according to fiber diameter and mesh size and is typically in the range of 40% and 60% by weight. For example, for a woven stainless steel fabric with a fiber diameter of 0.009 in. and a mesh size of 18×18 fibers/in$^2$, it is preferred that the coating comprise about 50% by weight of the mesh. The coated fiber mesh may be air dried for 8 hours or dried in an oven at a temperature in the range of 225° F. to 230° F. for a time period between 10 minutes to 20 minutes. A section of the fiber mesh (1) and intumescent coating (2) is shown in FIG. 1.

Figure 2:
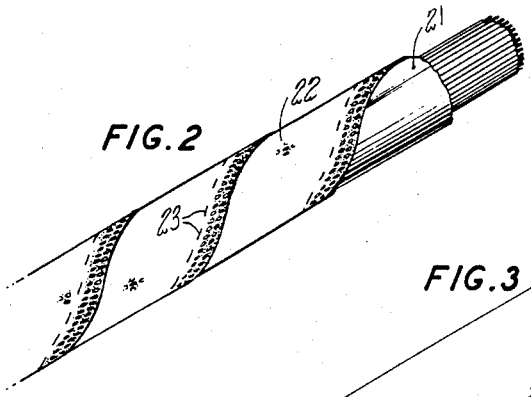
FIG. 2 shows a cable protected with a spirally wrapped tape of the covering of the present invention.

The coated mesh may be applied to a cable as shown in FIG. 2 by wrapping an elongated tape (22) of the coated mesh around the cable (21) in an overlapping spiral configuration with an overlap of about 40 percent to about 60 percent and preferably about 50 percent. The overlapping portions of the tape may be fastened together with fireproof fastening means (23), such as metal staples, clips or hooks.

Figure 3:
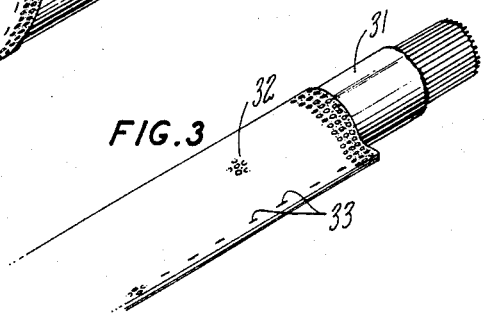
FIG. 3 shows a cable protected with a longitudinally wrapped tape of the covering of the present invention.

The coated mesh may be applied to a cable as shown in FIG. 3 by orienting the long axis of an elongated tape (32) of the coated mesh parallel with the long axis of the cable (31) and folding the tape (32) around the cable (31) to enclose the cable (31) and the overlapping portions of the tape fastened with fireproof fastening devices (33), such as metal staples, clips or hooks.

Figure 4:
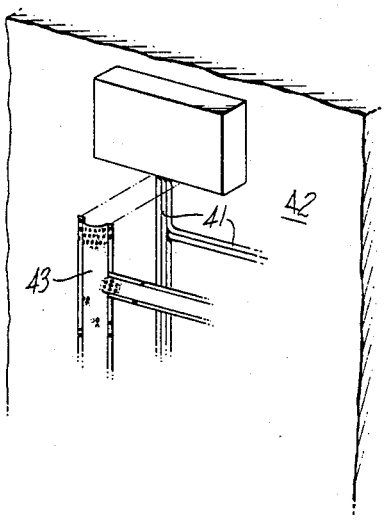
FIG. 4 shows an exploded view of a bulkhead mounted cable protected with the covering of the present invention.

If a cable or bundle of cables is attached to a metal substrate, such as a ship bulkhead (42), the exposed area of the cable (41) may be covered with a section of coated mesh (43) and the section of coated mesh (41) secured to the metal substrate as shown in FIG. 4 by, for example, spot welding the mesh to the metal substrate or by securing the mesh to the metal substrate with threaded fasteners.

In each of the above cases, multiple layers of coated mesh may be applied.

EXAMPLE

Woven stainless steel fabric with a wire diameter of 0.009 inch and a mesh size of 18×18 fibers per square inch is cut to form an elongated 6 inch wide strip. ALBI 107A intumescent coating is diluted with methylene chloride to give a viscosity of about 190 centipoise. The diluted coating is applied to one side of the woven stainless steel strip by means of conventional paint spraying apparatus using compressed air. The coating is allowed to dry for 8 hours under ambient conditions.

The coated mesh strip is applied to a first thermoplastic insulated copper conductor, $C_1$, by tightly wrapping the strip of coated mesh in an overlapping spiral configuration with an overlap of about 50 percent to cover the cable as shown in FIG. 2. The mesh is held in place using fireproof fastening devices to fasten the overlapping layers of mesh together.

A layer of ceramic thermal insulation is applied to a second thermoplastic insulated copper conductor, $C_2$, to cover the cable.

No additional protective covering is applied to a third thermoplastic insulated copper conductor, $C_3$.

To illustrate the problem of derating, the three conductors are operated in free air at 30° C. at the maximum allowable current capacity based on a single conductor in free air at 30° C.

The temperature at the copper-thermoplastic insulation interface of the unprotected conductor $C_3$ rises slightly during operation to reach an operating temperature of $T_3$, within the design parameters for the conductor.

The temperature of the conductor $C_1$ wrapped in a layer of the protective covering of the present invention increases during operation to reach a temperature $T_1$ which is approximately equal to $T_3$.

The temperature of the conductor protected by the ceramic insulation $C_2$ increases during operation to a temperature $T_2$ which is significantly higher than $T_3$ and above design temperature limitation for the conductor. The current conducted through $C_2$ must be reduced so that the temperature at the copper-thermoplastic interface closely approaches $T_3$.

To demonstrate the fire protection afforded by the protective covering of the present invention each of the three conductors is placed in contact with a gas flame.

Upon exposure to the flame, the unprotected thermoplastic insulation of conductor $C_3$ softens, flows and eventually ignites. The flame spreads from the point of contact in both directions along the surface of the conductor.

Upon exposure to the flame, the intumescent material of the covering of the present invention of conductor $C_1$ expands to obstruct the openings of the coated mesh to form a protective barrier and insulate the thermoplastic insulation from the flame. The protective coating and thermoplastic insulation of conductor $C_1$ do not ignite nor does the flame spread along the surface of the conductor.

The ceramic insulation on the conductor $C_2$, although responsible for derating conductor $C_2$, does protect the thermoplastic insulation from the flame. The ceramic coating and thermoplastic insulation of conductor $C_2$ do not ignite nor does the flame spread along the surface of the conductor.

The covering of the present invention offers lightweight, nonderating protection under condition of normal ambient temperature, by allowing heat transfer from the cable to its surroundings. Sections of the covering may be easily cut away and removed to allow ready access to the underlying cable. The unprotected section may then be easily repaired by patching when access to the cable is no longer required. Upon exposure to the elevated temperature associated with a fire the coating expands to afford fire protection similar to that obtained with conventional thermal insulation. The expanded coating insulates the cable from the flames and contains melting thermoplastic insulation to prevent the spread of fire along the cable.

Although this invention has been shown and described with respect to detailed embodiments thereof, it will be understood by those skilled in the art that various changes in form and detail thereof may be made without departing from the spirit and scope of the claimed invention.

I claim:

1. An insulated electrical cable, comprising:

an electrical conductor, a layer of thermoplastic material, substantially covering the electrical conductor for electrically insulating the electrical conductor, a protective layer substantially covering the layer of thermoplastic material, wherein the protective layer comprises:

a nonflammable, thermally intumescent material coated upon a flexible open network of corrosion resistant metallic fibers, wherein the coated fibers define a plurality of unobstructed open spaces, the open spaces allow heat transfer from the electrical conductor and the intumescent material expands upon exposure to a temperature sufficient to melt the layer of thermoplastic material to substantially obstruct the open spaces of the network, shield the electrical cable, and contain molten thermoplastic.

* * * * *